United States Patent [19]

Pennison

[11] Patent Number: 4,683,682

[45] Date of Patent: Aug. 4, 1987

[54] SAFETY LEVER FOR PORTABLE POWER TOOL

[75] Inventor: Robert A. Pennison, Bellville, Tex.

[73] Assignee: Dresser Industries, Inc., Dallas, Tex.

[21] Appl. No.: 910,114

[22] Filed: Sep. 19, 1986

[51] Int. Cl.[4] ..... B24B 55/04

[52] U.S. Cl. ..... 51/170 R; 51/134.5 F; 408/710; 192/135; 83/DIG. 1

[58] Field of Search ..... 51/170 R, 170 T, 170 PT, 51/134.5 F, 268; 83/DIG. 1; 408/710; 409/134; 74/612; 192/135

[56] References Cited

U.S. PATENT DOCUMENTS

| | | | |
|---|---|---|---|
| 2,422,755 | 6/1947 | Strother | 408/710 |
| 4,103,460 | 8/1978 | Law | 51/134.5 F |
| 4,145,848 | 3/1979 | Hutchins | 51/170 T |
| 4,558,539 | 12/1985 | Hansson | 51/134.5 F |

*Primary Examiner*—Roscoe V. Parker

[57] ABSTRACT

A powered hand tool as a housing containing an air pressure driven motor with an output spindle extending from a work side of the housing and a work device such as a grinding wheel mounted thereon. A guard is mounted with the work side of the housing and at least partially surrounds the work device or grinding wheel. A handle mounted with the housing is provided for an operator to hold the tool. An air pressure flow control valve is mounted in the handle and includes a valve actuator member extending from the handle. An actuating lever is secured to the housing by a removable lever mount located in a locking groove in the housing and held in place by a portion of the guard. With the guard in place the actuating lever mount is positioned for hand actuation upon grasping the handle. Removal of the guard from the housing releases the lever mount and disables the tool by allowing the lever mount to slide freely from the locking groove thus removing the actuating lever from the tool and discouraging unsafe operation of the powered hand tool with the work device guard removed.

10 Claims, 4 Drawing Figures

SAFETY LEVER FOR PORTABLE POWER TOOL

TECHNICAL FIELD

This invention is related to hand held fluid pressure driven power tools equipped with a personal safety guard around at least a portion of the working element of the tool. More specifically, this invention is related to air powered hand held grinders and the like that are equipped with a safety guard around a portion of the grinding wheel and have a safety device to prevent operation of the tool without the safety guard being in place.

BACKGROUND OF THE INVENTION

Good safety practice requires the use of a guard or other protective device on certain types of hand held power tools that because of the nature of the tool can cause serious injury to an operator contacting the tool's working member. Hand held grinding, brushing and cutting tools are known to constitute an obvious hazard. Because of this hazard numerous designs for such guards have been manufactured and provided in the past. Because the guard is only effective so long as it is in place on the tool some designs have been proposed to make the power tools inoperative should the guard be removed. One solution to this is to make the guard an integral part of the tool housing thus making removal of the guard impossible without extensive modification or substantial destruction of the tool's housing.

Other known air powered hand tools have the guard constructed to block a passageway connecting the main air inlet to the tool's driving motor. When the guard is removed air is dumped through this passageway and operation of the motor is not possible or is greatly impaired due to the leaking air. This type of guard construction requires a carefully machined surface on the guard structure to seal with appropriate mating surfaces of the tool's housing in order to insure proper operation of the power tool and prevent inadvertent leaking of the air supply.

SUMMARY OF THE INVENTION

This invention is a power tool safety lever and guard construction for a hand held power tool having the housing with a motor therein and an output spindle from the motor on a work side of the housing. A work device such as a grinding wheel is mounted with the spindle. A guard is mounted with the housing and extends therefrom at least partially surrounding the work device. A handle on the housing is provided for an operator to hold the tool. For air pressure powered motors the handle contains an air flow control valve with a valve actuator member extending from the handle. A valve actuating lever is positioned adjacent to and alongside the handle and contacts the valve actuator member when being grasped by the operator and pressed toward the handle. This lever is pivotally secured to a lever mount member that is in turn removably secured to the housing. The lever mount member is held in an operating position by a portion of the guard such that removal of the guard will release the lever mount member and disable the lever from proper operation.

One object of this invention is to provide a power tool safety device to prevent operation of the tool with the safety device to prevent operation of the tool with the safety guard removed that will overcome the aforementioned disadvantages of the prior art devices.

Still, one other object of this invention is to provide a power tool having a lever to control stopping and starting of the tool's motor that will be in proper operating position only when the power tool's protective guard is in place and will be disabled from operation when the guard is removed from the power tool housing.

Still, another object of this invention is to provide a safety device for a hand held power tool such as a grinder wherein a lever is used to stop and start the tool's motor and the lever is not retained in an operable position once a safety guard on the tool is removed.

Various other objects, advantages, and features of this invention will become apparent to those skilled in the art from the following discussion, taken in conjunction with the accompanying drawings in which:

Figure 1:
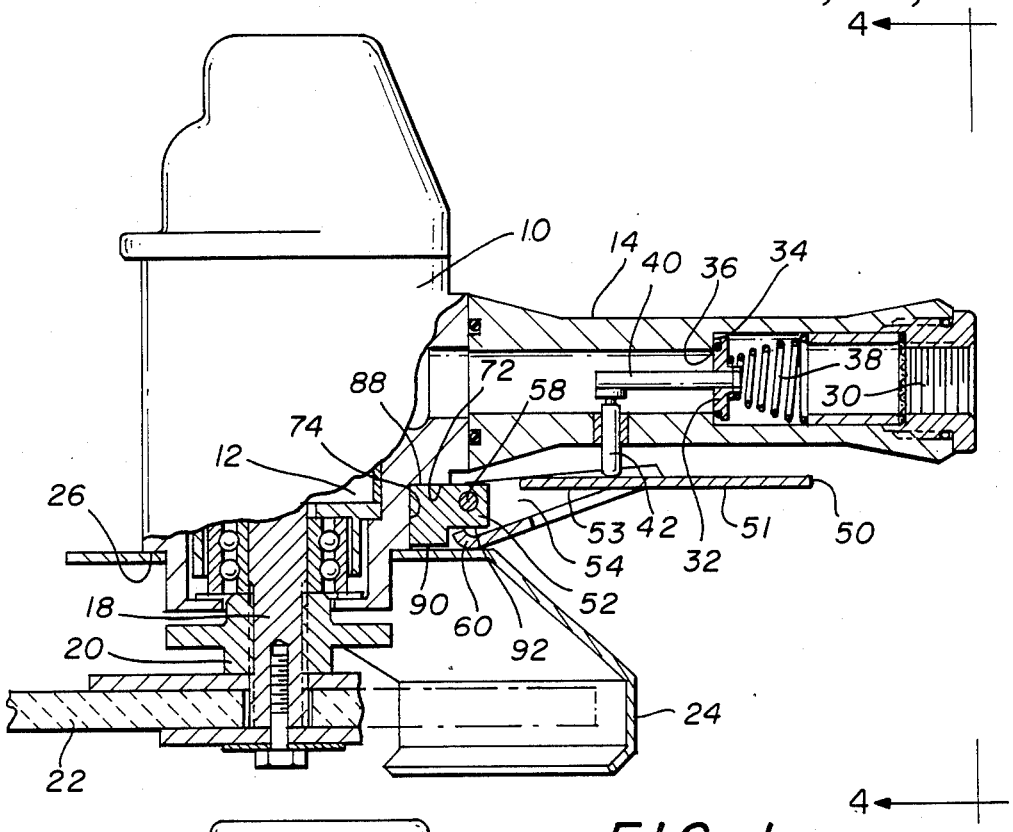
FIG. 1 is a side elevation view of a hand held power tool incorporating this invention with portions of the tool cutaway for clarity.
Figure 4:
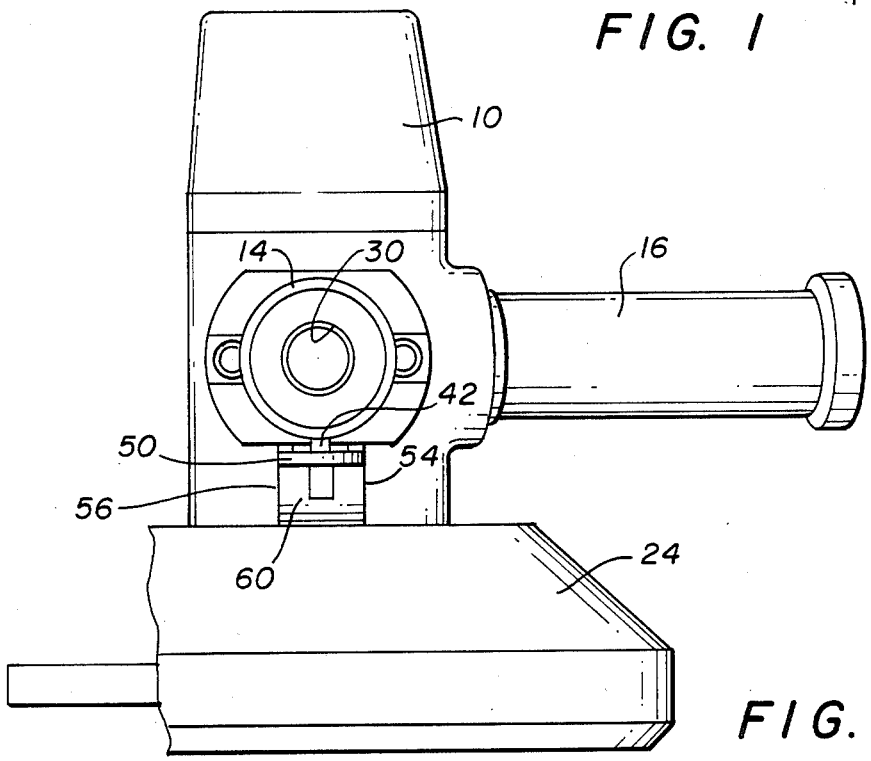
FIG. 4 is a side elevation view of the hand held power tool shown in FIG. 1, with the view taken from the air inlet end of the handle.

The following is a discussion and description of preferred specific embodiments of the power tool safety device of this invention, such being made with the reference to the drawings, whereon the same reference numerals are used to indicate the same or similar parts and/or structure. It is to be understood that such discussion and description is not to unduly limit the scope of the invention.

DETAILED DESCRIPTION

Figure 2:
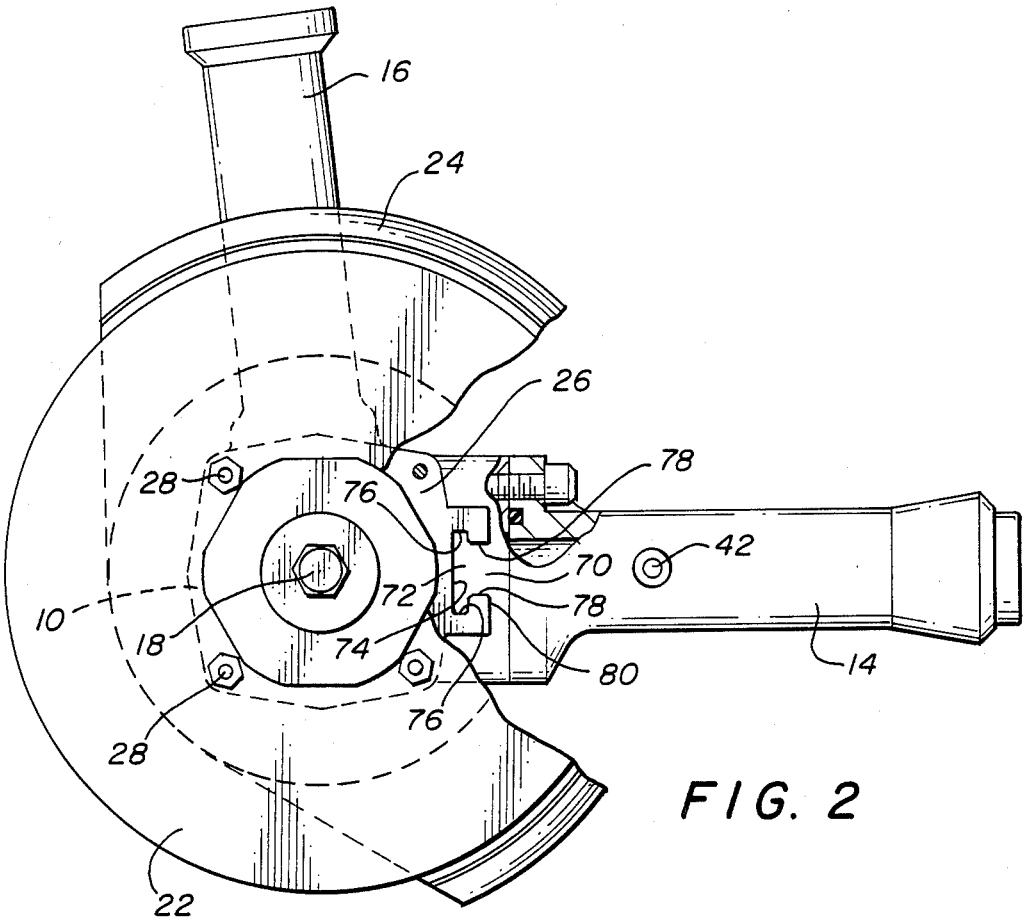
FIG. 2 is a bottom plan view of the hand held power tool shown in FIG. 1 with the work device or grinding wheel assembly and the actuating lever and lever mount removed exposing structural features of the handle and the tool housing.

Referring to FIGS. 1 and 2 a hand held grinder of the type employed in industrial applications is shown equipped with the safety device of this invention. This grinder or hand held power tool includes a housing 10 containing an air powered motor 12 and having a pair of handles 14 and 16 extending from the housing for an operator to grasp. Motor 12 has a spindle 18 extending therefrom with a grinding wheel mount or hub 20 on the extended end portion thereof for mounting a work device such as a grinding wheel 22 thereon. For convenience in the following discussion the work device will be referred to as a grinding wheel, however it is understood that such can be other devices, such as a wire brush, a scraper, a polisher, and other devices used on this character of portable power tool.

A guard 24 is mounted on the work side of housing 10 and extends to at least partially around grinding wheel 22 in a surrounding relation for protection of the operator. Guard 24 surrounds the portion of grinding wheel 22 that would be adjacent to the operator in normal use and exposes the opposite side portion of the grinding wheel for contact with the work piece being ground. Guard 24 is secured to housing 10 on a work side surface 26 by a plurality of fasteners or bolts 28.

For the power tool as shown in the drawings motor 12 is in a compressed air powered motor that is driven by a source of compressed air and connected to the power tool through an air inlet 30 in handle 14. Handle 14 contains an air flow control valve with a valve member 32 resting against a valve seat 34 having an O-ring seal member 36. Air valve member 32 is urged to a normally closed position by a compressed spring 38 mounted within handle 14. An air valve member lever 40 is secured to air valve member 32 and extends longitudinally through the hollow central portion of handle 14. An air valve actuator member 42 contacts air valve member lever 40 on one end and extends through handle 14 in the general direction of guard 24. Longitudinal movement of valve actuator member 42 into handle 14 displaces valve member lever 40 and unseats air valve member 32 permitting compressed air to pass from air inlet 30 to motor 12 for operation thereof.

A valve actuating lever 50 is pivotally mounted with tool housing 10 by a valve actuating lever mount 52. Actuating lever 50 is designed to be displaced by the grasp of an operator's hand to stop and start the motor. Displacing lever 50 controls the passage of air through the air valve by displacement of air valve actuator member 42 and in turn tilting air valve member 32 on air valve seat 34. Valve actuating lever 50 includes an elongated hand engaging portion 51 residing along side the lower portion of handle 14 and in a spaced relation thereto. This portion 51 of handle 50 is located within easy grasp of an operator's fingers.

The pivotally mounted end portion of valve actuating lever 50 includes a pair of facing side portions 54 and 56. Side portions 54 and 56 each have an aperture therethrough to receive and mount a pivot pin 58 for pivotally securing valve actuating lever 50 to lever mount 52. Extending between and adjoining lever side portions 54 and 56 is a curved end segment 60. Curved end segment 60 is curved upward as shown in FIG. 1 or toward hand engaging portion 51. The outer end of curved end segment 60 is shaped and positioned to contact a stepped surface on lever mount 52 when lever 50 is in a released position as shown in FIG. 1. Curved end segment 60 provides a limit stop to the movement of valve actuating lever 50 away from handle 14.

A mid portion of valve actuating lever 50 contains a tang segment 53 extending substantially in line with the hand engaging portion 51 of lever 50 and providing a contact surface for air valve actuator member 42. It is to be noted that valve actuating lever 50 is shaped with a pivotally mounted end portion being at a lower elevation and then the hand engaging portion 51 when viewed as shown in FIG. 1. This shaping is done in order to provide a proper spaced relation between lever mount 52 and handle 14 for movement of the lever by an operator.

The lever mount assembly includes lever mount member 52 and an associated lever mount locking groove 70 on a side portion of tool housing 10. Lever mount locking groove 70 has an opening to housing work side surface 26 on one portion thereof and an open side opening in the direction of valve actuating lever 50. Locking groove 70 includes a cross-sectionally enlarged closed end portion that is enlarged with respect to the open side thereof facing in the direction of valve actuating lever 50 as can be seen in FIGS. 1 and 2 together. The enlarged closed in portion of the groove is adapted to receive and support in a locking relation a tongue portion of lever mount 52.

Lever mount locking groove 70 has a closed end terminating in a closed end surface 72 oriented generally transverse to tool housing 10 and generally parallel to housing work side surface 26. Locking groove 70 has another closed end surface 74 oriented substantially perpendicular to the housing work side surface 26 and handle 14. Groove closed end surface 74 extends between groove end surface 72 and housing work side surface 26. The opposing sides of lever mount locking groove 70 are constructed in similar steps including first step portions 76 adjacent to groove closed end surface 74 and second step side portions 78 connected to the first step side portions 76 by a joining side wall segment. Second step side portions 78 each join the housing exterior surface 80 at the edge of the open side of the groove. Lever mount locking groove 70 is generally cross-sectionally T-shaped when viewed from the housing work side surface 26 as shown in FIG. 2. The first side portions 76 are spaced apart from each other further than are the second side portions thereby providing a wider and a cross-sectionally enlarged closed end portion on the groove to receive and mount a corresponding shaped tongue portion of valve actuating lever mount 52.

Figure 3:
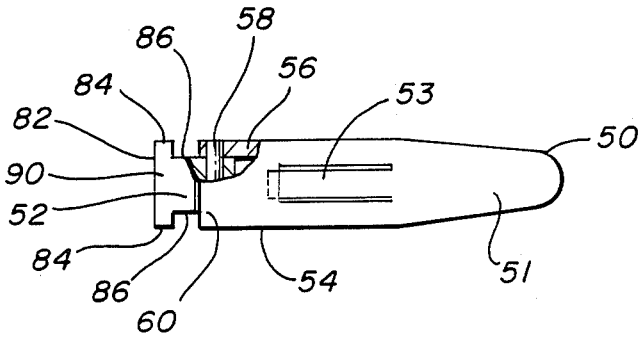
FIG. 3 is a bottom plan view of the actuating lever and associated mount removed from FIG. 2 with a portion thereof cutaway.

FIG. 3 shows valve actuating lever mount 52 attached to valve actuating lever 50 from the bottom side thereof in the orientation that it would be in when lever mount 52 is inserted into lever mount locking groove 70 as pictured in FIG. 2. Valve actuating lever mount 52 has a tongue end portion shaped to mount into and be lockingly retained within locking groove 70 and an opposite end portion upon which valve actuating lever 50 is mounted. The tongue end portion of lever mount 52 terminates at a tongue end 82 that extends between opposed stepped sides of lever mount 52. A first stepped side portion 84 joins end 82 and connects to a second narrower side portion 86. First side portions 84 are spaced apart further than second side portions 86 in order to cooperatively engage the associated stepped side construction of lever mount locking groove 70. A top surface 88 of lever mount 52 joins the sides 82, 84 and 86 and is adapted to rest adjacent locking groove closed end surface 72 when lever mount 52 is positioned in the groove as shown in FIG. 1. Lever mount bottom surface 90 joins sides 82, 84 and 86 and is generally parallel to top surface 88. The height of lever mount 52 in the tongue portion thereof is substantially the same depth as lever mount locking groove 70. This construction positions lever mount bottom surface 90 at an upper surface of guard 24. In order to retain lever mount 52 within locking groove 70 while the guard is in place.

The end portion of lever mount 52 opposite to the tongue portion thereof forms a lug portion between second side portions 86 that fits within the interior of lever sides 54 and 56 as shown in FIG. 3. The lug portion of lever mount 52 is reduced in height from the tongue portion thereof and includes a stepped bottom surface 92 shown in FIG. 2. This stepped surface 92 provides a contact surface for curved end segment 60 of valve actuating lever 50.

In the use of this invention valve actuating lever mount 52 is placed with the tongue portion thereof residing in the enlarged portion of lever mount locking groove 70 and valve actuating lever 50 located over the bottom side portion of handle 14 before guard 24 is mounted with tool housing 10. Subsequently, guard 24 is mounted on the working side surface 26 of tool housing 10 with a segment of the mounted side portion of guard 24 extending in overlying and covering relation to the open end portion of lever mount locking groove 70 so as to retain lever mount 52 within this groove. A work device such as the grinding wheel 22 is then secured to the motor output spindle 18 and work mount or hub 20.

In normal use of the tool an operator will hold handle 14 and grasp valve actuating lever 50 with his fingers and press it toward the handle thus opening the air flow control valve permitting air to enter the tool and causing the motor to operate. Because the valve actuating lever is secured to lever mount 52 removal of the safety guard 24 from housing 10 will release lever mount 52 and lever 50 from its operational relationship with the tool housing and handle. To operate the tool without the guard it would be necessary for an operator to press valve actuator member 42 with one finger. Typically, a significant pressure is required to displace the valve member against the force of the air pressure thus rendering it quite uncomfortable if not impossible for a person to operate the power tool with the valve actuating lever. The obvious advantage to this invention is that it renders the power tool quite difficult and uncomfortable to operate if the safety guard is removed from the tool housing thereby discouraging unsafe operation of the hand held power tool.

On those specific preferred embodiments of this invention that have been described in detail in the preceding description this description is not intended to limit the invention to the particular form or embodiments disclosed herein since they are recognized as illustrative of the invention rather than restrictive and it would be obvious for those skilled in the art that the invention is not so limited. Thus, the invention is declared to cover all changes and modifications of this specific example of the invention herein disclosed for purposes of illustration which does not constitute departure from the spirit and scope of the invention.

The embodiments of the invention in which an exclusive property or privilege is claimed or defined as follows:

1. A safety improved control lever and guard for an air pressure powered hand held tool, comprising:

(a) a tool housing having a handle;

(b) an air pressure driven motor mounted in said housing and operably connected to an output spindle extending from said housing;

(c) a work engaging means mounted on said spindle and a work means mounted on said work engaging means;

(d) a guard means mounted on said housing and at least partially surrounding said work means;

(e) an air pressure flow control valve means mounted in said handle and having a valve actuator member extending transversely from said handle operable to control the flow of air from a source of driving air into said motor;

(f) a valve actuating lever contacting said valve actuator member and operable upon movement by hand motion of an operator to displace said valve actuator member to open said control valve means to pass air therethrough and cause operation of said motor; and (g) a lever mount means pivotally mounting said valve actuating lever to said housing, said lever mount means being removably mounted with said housing and secured in place on said housing by a portion of said guard means such that removal of said guard means releases said lever mount means from its mounted position thereby disabling said valve actuating lever from operable contact with said valve actuator member.

2. The safety control lever and guard of claim 1, wherein:

said lever mount means is secured to said tool housing by an interlocking tongue and groove construction wherein a tongue on said lever mount means is secured in a groove in said tool housing by a portion of said guard being disposed over an opening of said locking groove thereby retaining said tongue in place therein.

3. The safety control lever and guard of claim 2, wherein:

said tool housing has a guard mount surface on one side thereof overlaid by a portion of said guard means, said housing has said locking groove formed therein and opening on one end to said guard mount surface and on an open side to the exterior side of said housing, said locking groove is adapted to receive and hold said lever mount means tongue in place with said guard means secured to said tool housing in order to retain said lever mount means in place for actuation of said valve actuator member.

4. The safety control lever and guard of claim 3, wherein:

said locking groove has a closed end portion that is cross-sectionally enlarged with respect to said open side thereof, and said lever mount means tongue has an enlarged end portion shaped to fit in and be retained within said locking groove closed end portion and a reduced size lever mount portion extending from said locking groove forming a lug to receive and pivotally mount one end portion of said valve actuating lever.

5. The safety control lever and guard of claim 4, wherein:

said locking groove has a generally cross-sectional T-shape when viewed transverse to motor's rotational axis, with the transverse portion thereof at said closed end portion and the adjoining segment thereof at said open side.

6. The safety control lever and guard of claim 5, wherein:

(a) said valve actuator member is elongated, extends transversely from said handle and is displaceable longitudinally into said handle to operably open said flow valve;

(b) said lever mount means is positioned on said housing between said guard and said handle with a portion of said lever overlying a portion of said handle including said valve actuator member in position such that an operator of said tool can grasp said lever along with said handle and displace said lever to contact and displace said valve actuator member and in turn open said air pressure flow control valve means; and (c) said work means being a rotary cutting device having the character of a grinding wheel and the like.

7. A powered hand tool comprising:

(a) a tool housing having a handle extending therefrom;

(b) an air pressure driven motor mounted in said housing with an output spindle extending from a work side of said housing;

(c) a work engaging means mounted on said spindle with a work means secured thereto;

(d) a guard means mounted on said work side of said housing and at least partially surrounding said work means;

(e) an air pressure flow control valve mounted in said handle and operable to control the flow of air from a driving air source into said motor and having a valve actuator member extending from said handle;

(f) a valve actuating lever overlying a portion of said handle and positioned to contact said valve actuator member and displace same to open said air pressure flow control valve member when grasped by the hand of an operator and pressed toward said handle;

(g) a valve actuating lever mount assembly including a mounting groove in said tool housing and a lever mount means removably mounted therein, said lever mount means having said valve actuating lever pivotally mounted thereto, said mounting groove including a locking groove portion formed in a side of said housing having an end opening to said work side of said housing and normally covered by a portion of said guard means, said locking groove portion having an open side opening in the same direction as said handle, said locking groove portion receiving and mounting a correspondingly shaped tongue portion of said lever mount means. therein with a lug portion of said lever mount means extending from said open side and pivotally mounting one end portion of said valve actuating lever.

8. The powered hand tool of claim 7, wherein: said locking groove portion has a closed end portion that is cross-sectionally enlarged with respect to said open side, and said lever mount means tongue has an enlarged end portion shaped to fit in and be retained within said locking groove closed end portion and having a reduced size lever mount portion extending from said locking groove portion forming a lug to receive and pivotally mount said valve actuating lever.

9. The powered hand tool of claim 7, wherein: said locking groove portion has a generally cross-sectionally T-shape with the transverse portion thereof at said closed end portion and the adjoining segment thereof at said open side thereof.

10. The powered hand tool of claim 9, wherein: said valve actuating lever has a pivotal mount end portion secured with said lug portion by a pivot pin, a hand engaging portion on the opposite end portion thereof is positioned along side said handle to be grasped by an operator's hand, and a tang portion extends from a mid portion thereof to engage said valve actuator member.

* * * * *